US005993247A

United States Patent [19]

Kidd

[11] Patent Number: 5,993,247

[45] Date of Patent: Nov. 30, 1999

[54] ELECTRICAL CONNECTION FOR FLEX CIRCUIT DEVICE

[75] Inventor: Richard Louis Kidd, Stow, Ohio

[73] Assignee: General Motors Corporation, Detroit, Mich.

[21] Appl. No.: 08/980,671

[22] Filed: Dec. 1, 1997

[51] Int. Cl.[6] ..... H01R 9/07

[52] U.S. Cl. ..... 439/495; 439/77; 439/329; 439/567

[58] Field of Search ..... 439/77, 67, 329, 439/492, 493, 495, 567, 499

[56] References Cited

U.S. PATENT DOCUMENTS

| | | | |
|---|---|---|---|
| 4,634,195 | 1/1987 | Shoemaker | 439/495 |
| 4,869,670 | 9/1989 | Ueda et al. | 439/34 |
| 5,195,897 | 3/1993 | Kent et al. | 439/484 |
| 5,265,322 | 11/1993 | Fisher et al. | 29/848 |
| 5,306,162 | 4/1994 | Armendariz | 439/67 |

*Primary Examiner*—Lincoln Donovan
*Attorney, Agent, or Firm*—Patrick M. Griffin

[57] ABSTRACT

An electrical connection includes a wiring harness and an electrical device. The electrical device has a molded plastic support and a flexible printed circuit. The molded plastic support has an end wall that includes mechanical locks and the flexible printed circuit has a connector portion that overlies the end wall. The wiring harness includes a second flexible printed circuit and a plastic end connector that backs a connector portion of the second flexible printed circuit. A clamp bracket is attached to the end wall of the molded plastic support by mechanical locks and clamps the plastic end connector and the connector portion of the second flexible printed circuit against the end wall with the connector portion of the second flexible printed circuit engaging the connector portion of the flexible printed circuit of the electrical device. The clamp bracket may be insert molded or an integral part of an automotive trim piece, such as inner door panel or instrument panel fascia.

4 Claims, 2 Drawing Sheets

ELECTRICAL CONNECTION FOR FLEX CIRCUIT DEVICE

TECHNICAL FIELD

This invention relates generally to electrical connectors and more particularly to an electrical connection for a flex circuit device.

BACKGROUND OF THE INVENTION

Automobile doors have several switches mounted on the interior trim panel of the door for controlling various electromechanical devices such as door locks, windows, adjustable side view mirrors, and seat adjusters that are actuated by electric motors. Multi-function switches, such as seat adjuster switches that control seat height and seat back tilt, often use flexible printed circuit technology to provide open circuit pads that are closed by a moveable conductor such as a conductive rubber button. In the past, electrical connections between the flexible printed circuit of the switch, the power source and the electro- mechanical device have been made by a conventional wiring harness comprising a plurality of wire conductors having end terminals that are housed in a connector body that is attached to a support for the flexible printed circuit. See for instance, U.S. Pat. No. 5,071,358 granted to Richard A. Petrosky Dec. 10, 1991, for an adapter locking clip.

While these conventional wiring harness arrangements have been used successfully for many years, the conventional wiring harness arrangement is expensive and bulky.

SUMMARY OF THE INVENTION

The object of this invention is to provide an inexpensive and compact electrical connection for an electrical device that includes a flexible printed circuit, such as a seat adjuster switch that has a flexible printed circuit and that is mounted on the interior trim panel of a vehicle door.

A feature of the invention is that the electrical connection includes a wiring harness that comprises a second flexible printed circuit and a flat plastic end connector that is inexpensive and compact in comparison to a conventional wiring harness that has individual electrical wires having end terminals that are plugged into a plastic connector body.

Another feature of the invention is that the electrical connection has a clamp bracket that attaches the flexible printed circuit of the wiring harness to the flexible printed circuit of the electrical device and at the same time clamps the connector portions of the flexible printed circuits against each other to establish electrical connections.

Still another feature of the invention is that the electrical connection has cooperating mechanical connectors that align the connector portions of the flexible printed circuits as well as clamp the connector portions against each other to establish electrical connections.

Yet another feature of the invention is that the electrical connection uses spring blade terminals that are simple metal stampings to enhance the economy of the arrangement.

Still yet another feature of the invention is that the electrical connection has a support for the flexible printed circuit that is shaped so that the spring blade terminals engage the contact portion of the second flexible printed circuit under their own self biasing forces.

These and other objects, features and advantages of the invention will become more apparent from the following description of a preferred embodiment taken in conjunction with the accompanying drawing.

DESCRIPTION OF THE PREFERRED EMBODIMENT

Figure 1:
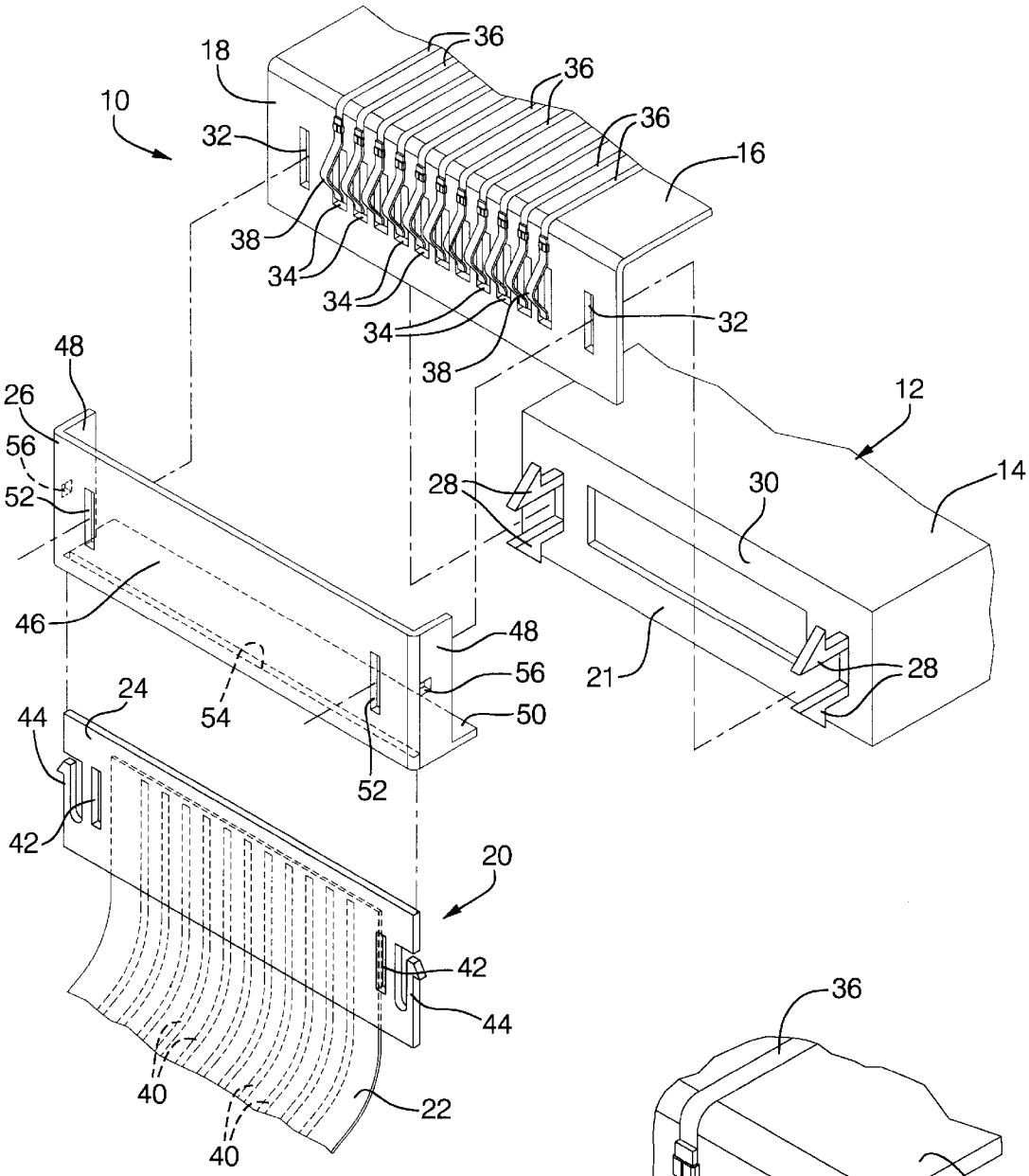
FIG. 1 is an exploded perspective view of an electrical connection in accordance with the invention.

Referring now to FIG. 1, an electrical connection 10 of the invention is illustrated in conjunction with an electrical device such as an automotive seat adjuster switch 12 that comprises a molded plastic support 14 and a flexible printed circuit 16 that includes a connector portion 18. Electrical connections are made to the flexible printed circuit 16 by a wiring harness 20 that comprises a flexible printed circuit 22 having a plastic end plate 24. Connector portion 18 of the flexible printed circuit 16 and the plastic end plate 24 of the flexible printed circuit wiring harness 20 are attached to an end wall 21 of the molded plastic support 14 by a clamp bracket 26. Clamp bracket 26 cooperates with mechanical locks 28 of the support 14 that extend through connector portion 18 and plastic end plate 24. Clamp bracket 26 may be insert molded or be an integral part of an automotive trim piece, such as an inner door panel (not shown).

The end wall 21 of the molded plastic support 14 has an elongated slot 30 between the mechanical locks 28 that are widely spaced apart for attaching connector portion 18 of the flexible printed circuit 16. Flexible printed circuits are well known and need not be described in detail. Briefly flexible printed circuits such as flexible printed circuit 16 comprise two sheets of polyester plastic insulation or other dielectric substrate material that are bonded together to hold a plurality of thin copper circuit strips in a predetermined pattern to provide a desired circuit and with selected faces of the circuit strips exposed for making electrical connections.

Figure 2:
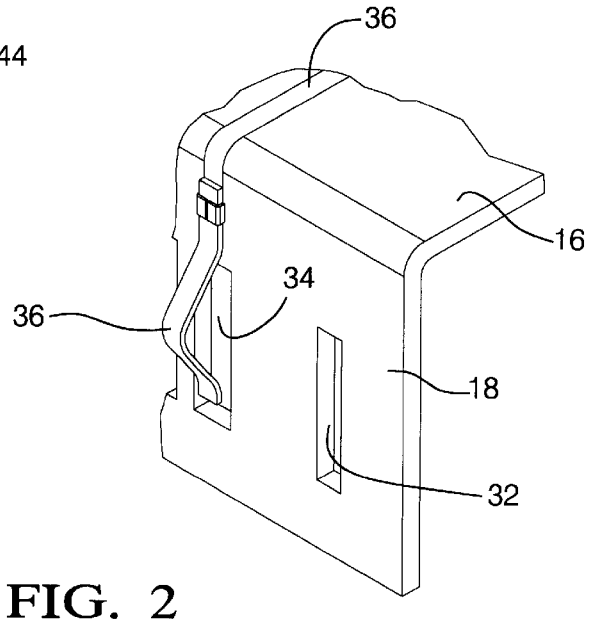
FIG. 2 is an enlarged perspective view of a detail of the electrical connection shown in FIG. 1.

Connector portion 18 of flexible printed circuit 16 has two rectangular lock holes 32 that are widely spaced apart to receive the respective mechanical locks 28 of support 14. Connector portion 18 has several spaced cutouts 34 between lock holes 32 and a like number of copper strips 36 that terminate at or near the respective edges of the cutouts. Spring blade terminals 38 are stapled or otherwise suitably attached to the end portions of the copper strips 36 so as to extend over the cutouts 34 in cantilever fashion as best shown in FIG. 2. Spring blade terminals 38 preferably are simple metal stampings that are cut or stamped from flat spring metal stock and bent to provide a bow shaped tongue.

Figure 5:
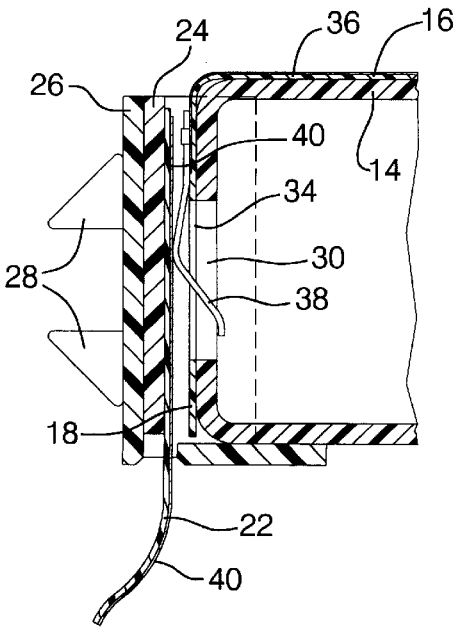
FIG. 5 is a section taken substantially along the line 5—5 of FIG. 3 looking in the direction of the arrows.

Flexible printed circuit 22 has an end portion that is glued or otherwise suitably secured to end plate 24. Flexible printed circuit 22 has a number of copper strips 40 and these copper strips have exposed faces in the end portion for making electrical contact with the bow shaped spring blade terminals 38 as best shown in FIG. 5. End plate 24 has two widely spaced lock holes 42 for connecting wiring harness 20 to support 14 and two flexible lock arms 44 at the respective side edges for attaching wiring harness 20 to clamp plate 26.

Clamp plate 26 has an end wall 46 with a wing 48 at each end and a bottom wall 50. End wall 46 has two widely spaced lock holes 52 for attaching clamp plate 26 to support 14. Bottom wall 50 has a thin narrow slot 54 for receiving the end of wiring harness 20 and wings 48 have retainer slots 56 for receiving nibs at the ends of lock arms 44 to retain end plate 24 adjacent end wall 46 after it is inserted through slot 54.

Electrical connections are made in the following manner. Connector portion 18 of flexible printed circuit 16 is juxtaposed the outer face of end wall 12 and loosely and temporarily held in place by mechanical locks 28. Other portions of flexible printed circuit 16 are also suitably attached to support 14.

Figure 3:
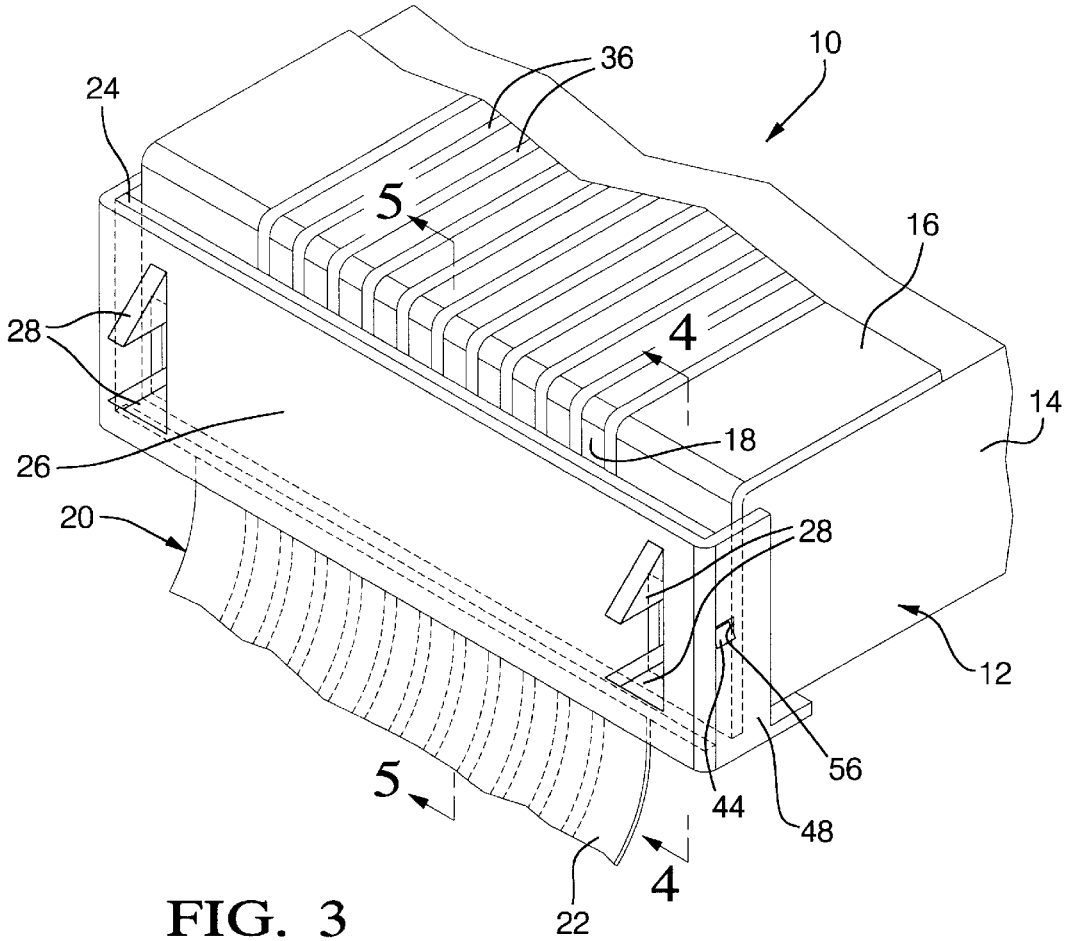
FIG. 3 is a perspective view of the electrical connection shown in FIG. 1.
Figure 4:
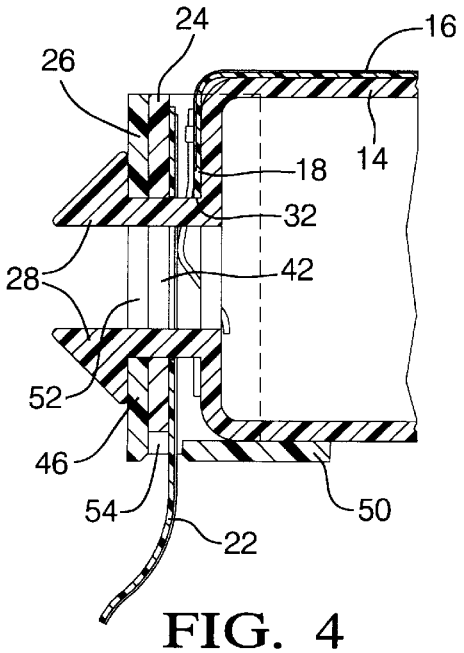
FIG. 4 is a section taken substantially along the line 4—4 of FIG. 3 looking in the direction of the arrows.

Plastic end plate 24 with an end portion of flexible printed circuit 22 secured thereto is inserted into slot 54 of clamp plate 26 and locked in place by the nibs of lock arms 44 engaging in slots 56. End plate 24 and clamp plate 26 form a subassembly in which lock holes 42 and 52 are aligned for receiving mechanical locks 28. The subassembly comprising clamp plate 26 and the flexible printed circuit wiring harness 20 is then attached to the end wall 21 of support 14 by snapping mechanical locks 28 through aligned lock holes 42 and 52 as best shown in FIGS. 3 and 4. The connector portions of the flexible printed circuits 16 and 22 are now firmly clamped in place making good electrical connections under the self biasing forces of the spring blade terminals 36 as best shown in FIG. 5. Besides clamping the flexible printed circuits 16 and 22 against each other, the mechanical locks 28 also are instrumental in aligning the connector portions of the flexible printed circuits with each other due to the use of the lock holes 32, 42 and 52 which are sized for an accurate fit with the portions of mechanical locks 28 behind the barbs.

While the individual cutouts 34 in connector portion are preferable for terminal isolation, a single cutout or recess such as shown in the Petrosky '358 patent discussed above may be used. Moreover, the slot 30 can be reduced or eliminated so that the terminal ends are supported to increase the terminal engagement force. In other words, many modifications and variations of the present invention in light of the above teachings may be made. It is, therefore, to be understood that, within the scope of the appended claims, the invention may be practiced otherwise than as specifically described.

I claim:

1. An electrical connection comprising:

an electrical device having a molded plastic support and a flexible printed circuit, the molded plastic support having an end wall that includes mechanical locks and the flexible printed circuit having a connector portion that overlies the end wall, a wiring harness that has a second flexible printed circuit and a plastic end plate secured to a back of a connector portion of the second flexible printed circuit, the plastic end plate having lock arms for attaching the plastic end plate to a clamp bracket, the clamp bracket engaging the mechanical locks to attach the plastic end plate and the connector portion of the second flexible printed circuit secured thereto to the end wall of the support so that the connector portion of the second flexible printed circuit is clamped against the connector portion of the flexible printed circuit of the electrical device, and the plastic end plate having two widely spaced lock holes receiving the mechanical locks of the support when the clamp bracket is attached to the end wall of the support.

2. The combination as defined in claim 1 wherein the end wall of the molded plastic support has an elongated slot between the mechanical locks and the connector portion of the flexible printed circuit has several spaced cutouts and a like number of copper strips that terminate at or near an edge of the respective cutouts and bow shaped spring blade terminals are attached to the end portions of the copper strips so as to extend over the cutouts in cantilever fashion.

3. The combination as defined in claim 2 wherein the second flexible printed circuit has a number of copper strips that have exposed faces for making electrical contact with the terminals.

4. The combination as defined in claim 1 wherein the mechanical locks are bifurcated mechanical locks having barbs and wherein the connector portion of the flexible printed circuit, the plastic end plate of the wiring harness and the clamp plate all have locking holes that receive portions of the mechanical locks inboard of the barbs so as to align the contact portions of the flexible printed circuit and the second flexible printed circuit with each other.

* * * * *